US005265457A

United States Patent [19]

Hayashi et al.

[11] Patent Number: 5,265,457

[45] Date of Patent: Nov. 30, 1993

[54] METHOD OF FORMING AN OIL GROOVE ON THE END SURFACE OF A ROTOR OF AN ALUMINUM ALLOY

[75] Inventors: Tetsuya Hayashi; Tosio Fujiwara, both of Itami, Japan

[73] Assignee: Sumitomo Electric Industries, Ltd., Osaka, Japan

[21] Appl. No.: 969,516

[22] Filed: Oct. 30, 1992

Related U.S. Application Data

[63] Continuation of Ser. No. 654,670, Feb. 13, 1991, abandoned.

[30] Foreign Application Priority Data

Feb. 16, 1990 [JP] Japan ..... 2-33981

[51] Int. Cl.[5] ..... B21K 1/28

[52] U.S. Cl. ..... 72/364; 29/888.025; 418/178

[58] Field of Search ..... 418/77, 178, 179; 72/364, 412; 29/888.025

[56] References Cited

U.S. PATENT DOCUMENTS

| | | | |
|---|---|---|---|
| 3,469,433 | 9/1969 | Fresch et al. | 72/364 |
| 4,384,828 | 5/1983 | Rembold et al. | 418/178 |
| 4,689,864 | 9/1987 | Fukuma et al. | 72/412 |
| 4,815,953 | 3/1989 | Iio | 418/179 |

FOREIGN PATENT DOCUMENTS

| | | | |
|---|---|---|---|
| 36945 | 2/1988 | Japan | 72/412 |

*Primary Examiner*—Lowell A. Larson
*Attorney, Agent, or Firm*—Wenderoth, Lind & Ponack

[57] ABSTRACT

An oil groove is formed on the end surface of a rotor of an aluminum alloy for a compressor of a vane type, in an economical manner by a method comprising forming the oil groove of a concave type on the end surface of the rotor slidably moving in contact with a side plate by warm-pressing a die stamp.

1 Claim, 1 Drawing Sheet

METHOD OF FORMING AN OIL GROOVE ON THE END SURFACE OF A ROTOR OF AN ALUMINUM ALLOY

This application is a continuation of now abandoned application, Ser. No. 07/654,670, filed on Feb. 13, 1991.

BACKGROUND OF THE INVENTION

1. Field of the Invention

The present invention relates to an improvement in an aluminum rotor for a compressor of a vane rotary type, and in particular, it is concerned with a method of forming an oil groove for preventing adhesion in a light aluminum alloy rotor.

2. Description of the Prior Art

A rotor of a compressor used for car air conditioners has a plurality of vane grooves through which vanes slidably move as shown in FIG. 1, and is consolidated in one body with a rotary shaft. The rotor is revolved while being slidably moved on the inner wall surfaces of side plates fixed to both sides of a cylinder block. A refrigerant gas is drawn in a compression space partitioned by five components of the rotor, vane, cylinder block and both side plates, and is then compressed and discharged. Since the compression space requires airtightness it is designed so that these components have very small clearances among them, and in particular, when the rotor and side plates are slidably moved under compressive force, adhesion tends to take place between them.

Up to the present time, steel materials or ferrous sintered alloys have been used as the rotor and flake graphite cast iron or ferrous sintered alloys have been used as the side plate. In combinations of ferrous materials, the problem of adhesion is not serious since the materials are relatively excellent in wear resistance and the flake graphite cast iron or sintered alloys are excellent in oil retention. As occasion demands, an oil groove has been provided on one side surface or both side surfaces of a rotor to prevent such adhesion.

Of late, it has been studied to convert the material of a compressor from ferrous materials to aluminum, with the increased necessity for realizing a light weight compressor. Thus, it has been rendered possible to make a rotor of aluminum, for which aluminum could not be used up to the present time, by development of a powdered aluminum alloy consisting of a quenched and solidified powder and a high strength aluminum material, with the progress of the continuous casting technique. As to the side plate, the conversion of the material thereof into aluminum has also been possible by the use of high silicon aluminum materials such as A 390 material (commercial name). These alloys are not sufficient in adhesion resistance between the rotor and side plate in spite of the fact that large amounts of alloying components such as Si, etc. are contained therein so as to improve the wear resistance and adhesion resistance and to maintain the clearance precision at a high level. In particular, since adhesion tends to readily occur in a case where oil is exhausted on the sliding surface, an oil groove is necessary at the end surface of the rotor.

Since in the case of a rotor of an aluminum alloy, it is impossible to form an oil groove during powder compacting as in the case of the prior art rotors of sintered ferrous materials, because of the restriction on the production method, a step of working the oil groove should nevertheless be newly added. As the working method, an end mill or discharge working can be taken into consideration, but these methods have a problem that the installation thereof is of high rank and the working cost is too high. Furthermore, in the end mill working, the degree of freedom for imparting a groove shape is small.

SUMMARY OF THE INVENTION

It is an object of the invention to provide a method of making a rotor of an aluminum alloy whereby the above described problems can be solved.

It is another object of the present invention to provide a method of making a rotor of an aluminum alloy for a compressor of a vane rotary type, provided with an oil groove on the end surface of the rotor in an economical manner.

These objects can be attained by a method of forming an oil groove on the end surface of a rotor of an aluminum alloy for a compressor of a vane rotary type, which comprises forming the oil groove of a concave type on the end surface of the rotor slidably moving in contact with a side plate by warm-pressing a die stamp.

BRIEF DESCRIPTION OF THE DRAWINGS

The accompanying drawings illustrate the principle and merits of the invention.

DETAILED DESCRIPTION OF THE INVENTION

The present invention provides a method of forming an oil groove of a rotor of an aluminum alloy in a simple and economical manner, which comprises warm-pressing a die stamp to form a concave groove on the end surface of the rotor which is to slidably move with a side plate.

In a preferred embodiment of the present invention, the aluminum alloy contains 12 to 30% by weight of silicon since it is required that the aluminum alloy, as a material of the rotor as described above, has a lower coefficient of thermal expansion, higher wear resistance and higher Youngs modulus in order to maintain stable clearance with high precision between the rotor and other parts, and if necessary, the aluminum alloy contains 0.5 to 5.0% by weight of Cu and 0.2 to 2.0 by weight of Mg, as aging and hardening elements for increasing the strength and hardness. As occasion demands, transition elements such as Fe, Ni, Mn, etc. are incorporated in a proportion of 1.0 to 10.0% by weight so as to improve heat resistance, wear resistance and mechanical properties.

Preferably, pressing the die is ordinarily carried out at a temperature of 150 to 450° C. to soften the rotor itself, and the metal die for forming an oil groove, used during the same time, has such a protrusion that its point shape R is in the range of 0.1 to 2.0 mm and the tangent angle on the side surface of the protrusion is in the range of 30° to 75°. The depth of the oil groove is generally at most 2.0 mm.

Figure 1:
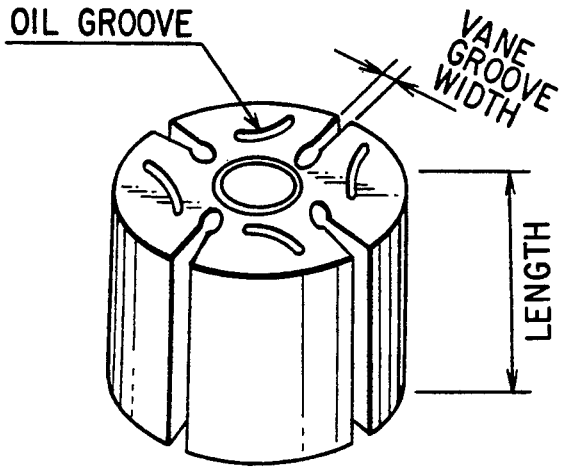
FIG. 1 is a schematic view of a rotor for a compressor of a vane rotary type, FIG. 2 (A) and FIG. 3 (A) are respectively cross-sectional views of metal dies used for pressing and forming oil grooves as shown in FIG. 1, and FIGS. 2 (B) and FIG. 3 (B) are schematic views of the shapes of the oil grooves respectively obtained by the above described metal dies.
Figure 2A:
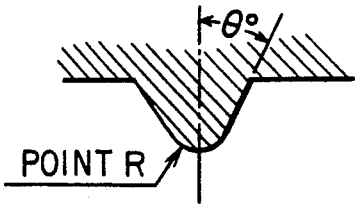
Figure 2B:
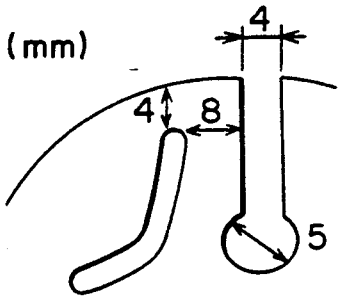
Figure 3A:
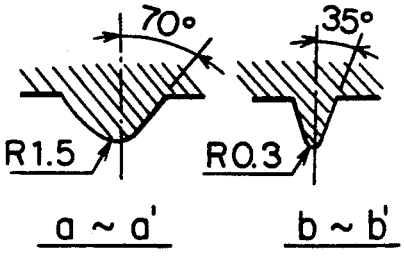
Figure 3B:
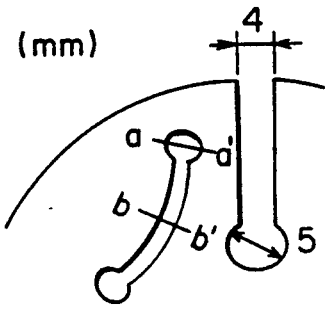

FIG. 2 (A) and FIG. 3 (A) are respectively cross-sectional views of examples of metal dies used for pressing and forming oil grooves as shown in FIG. 1, and FIG. 2 (B) and FIG. 3 (B) are schematic views of the oil grooves obtained by the above described metal dies. In FIG. 2 (A), the curvature radius R and the tangent angle $\theta$ of the side surface of the protrusion are shown to represent the point shape of the protrusion of the metal die.

The above described composition of an aluminum alloy, as a material of a rotor suitable for the present invention, will be illustrated hereinafter. The aluminum alloy can be any of powder-sintered alloys and alloys made by continuous casting.

Si as a predominant additive element is effective for lowering the expansion coefficient and improving the wear resistance and toughness by increasing the content thereof. If the content of Si is less than 12% by weight, the coefficient of thermal expansion is high and the wear resistance is not sufficient, while if more than 30% by weight, the ductility is deteriorated and the notch toughness of the rotor is lowered. Thus, the content of Si should be in the range of 12.0 wt % to 30.0 wt %. Furthermore, when the content of Si is less than 12% by weight, workability of the material is large and accordingly, it is not necessary to effect warm-pressing a die stamp as one feature of the present invention. When exceeding 30% by weight, the ductility of the material is lowered so that cracking tends to take place by pressing a die stamp. From this point of view, it is also preferred that the content of Si is in the range of from 12.0% by weight to 30% by weight.

Cu and Mg are age-hardening elements for increasing the strength and hardness of alloys. If the content of Cu is less than 0.5% or that of Mg is less than 0.2% it is impossible to obtain a sufficient strength and hardness. If the content of Cu is more than 5% or that of Mg is more than 2% by weight, coarse precipitates are formed to rather deteriorate the strength and lower the heat stability. Therefore, it is desired that the content of Cu is in the range of 0.5 to 5.0% by weight and that of Mg is in the range of 0.2 to 2.0% by weight.

In order to improve the heat resistance, wear resistance and mechanical properties, if necessary, transition elements such as Fe, Ni, Mn, etc. are incorporated in the alloy. If the contents thereof are less than 1.0% by weight, the additive effects are small, while if more than 10.0% by weight, the toughness of the material is lowered, the reliability of the material is decreased and the workability is lowered so that cracking tends to take place by pressing a die stamp. Thus, the transition elements are preferably incorporated in a proportion of 1.0 to 10.0% by weight.

When an oil groove is formed in a rotor having the above described composition, cold-pressing a die stamp results in cleavage or cracking because of large amounts of transition elements and Si serving to lower the ductility of the material.

Accordingly, it is required to effect the pressing of the die stamp under such a state that the material is heated and softened. The heating temperature depends on the composition of the material and the shape of the oil groove, but the rotor itself is preferably heated at 150° to 450° C. during pressing a die stamp. If the temperature is lower than 150° C., cleavage or cracking tends to occur and the deformation resistance is so large that a high compressing force is required. When exceeding 450° C., the material is annealed and precipitated or crystallized materials such as Si crystals become coarser than required, which deteriorates the quality of the material, while in addition, the related installation is of a higher cost. Therefore, the heating temperature of the rotor itself during pressing a die is preferably 150° to 450° C.

Limitation of the range in the protrusion shape of a metal die will now be illustrated. Since the rotor material contains large amounts of transition elements or Si serving to lower the ductility as described, cleavage or cracking tends to take place even in the case of warm-pressing a die. In particular, if the point shape R of the protrusion is less than 0.1 mm, cleavage or cracking tends to occur, while if the point R exceeds 2.0 mm, a large pressing force is required when it is desired to maintain a sufficient depth of the oil groove so that the quantity of deformation in the vertical direction to the pressing direction is large and the vicinity of the vane groove of the rotor is deformed to narrow the width of the vane groove and to lower the dimensional precision. Thus, it is desired that the point shape R of the protrusion of the metal mold is in the range of 0.1 to 2.0 mm.

When the tangent angle at the side surface of the protrusion of the metal mold is less than 30°, the rise toward the end surface of the rotor is so large that chamfering takes place between the end part of the protrusion and the rotor material. When larger than 75°, a similar problem arises to the case where the point shape R is large. Thus, it is desired that the tangent angle of the protrusion of the metal die is in the range of 30° to 75° in the pressing direction.

The depth of the oil groove obtained by pressing a metal die is ordinarily at most 2.0 mm, since if more than 2.0 mm, cleavage or cracking tends to take place and the material is removed toward the end surface or the vicinity of the vane grooves by plastic deformation to hardly obtain dimensional precision.

As illustrated above, according to the present invention, the oil groove can be formed on the rotor end surface of an aluminum alloy of a compressor by warm-pressing a die to form a concave groove part using a simple pressing apparatus with a simple operation, a low cost and a high yield of material.

EXAMPLES

Using 15 powder-sintered aluminum alloys and 2 continuous casting aluminum alloys as the rotor material, experiments were carried out with varying the pressing and forming conditions, thus obtaining results as shown in Table 1, in which Sample Nos. 1 to 21 were powder-sintered alloys and Sample Nos. 22 to 29 were continuous casting alloys. In Table 1, the results were assessed by marks, ◎: very good, o: good, x: not good.

TABLE 1

Results of Pressing and Forming Experiments

| Sample No. | Alloy Composition of Rotor (wt %) Si | Cu | Mg | Fe | Ni | Mn | Temperature (°C.) | Shape of Die Protrusion: Shape | Point R (mm) | Tangent angle θ° | Die Load (Ton) | Groove Depth after Forming (mm) | Maximum Deformation in Length Direction (mm) | Maximum Deformation of Vane Groove (mm) | Occurrence of Cleavage and Cracking | Judgement |
|---|---|---|---|---|---|---|---|---|---|---|---|---|---|---|---|---|
| 1 | 8 | 4.1 | 0.6 | <0.3 | <0.1 | 0.3 | 300 | as shown in FIG. 2(A) | 0.8 | 60 | 5.0 | 1.4 | 0.05 | 0.06 | | ◎ |
| 2 | 12 | 4.0 | 0.5 | <0.3 | <0.1 | 0.3 | | | | | 5.0 | 1.0 | 0.03 | 0.04 | | ◎ |
| 3 | 20 | 3.6 | 0.5 | <0.3 | <0.1 | 0.3 | | | | | 5.0 | 0.9 | 0.03 | 0.04 | | ◎ |
| 4 | 30 | 3.2 | 0.4 | <0.3 | <0.1 | 0.2 | | | | | 5.0 | 0.7 | 0.03 | 0.05 | | ○ |
| 5 | 35 | 2.9 | 0.4 | <0.3 | <0.1 | 0.2 | | | | | 5.0 | 0.6 | 0.03 | 0.04 | yes | x |
| 6 | 20 | 1.0 | 0.2 | <0.3 | <0.1 | 0.3 | | | | | 5.0 | 1.0 | 0.04 | 0.05 | | ◎ |
| 7 | 20 | 4.5 | 1.6 | <0.3 | <0.1 | 0.3 | | | | | 4.2 | 1.1 | 0.05 | 0.05 | | ○ |
| 8 | 20 | 5.8 | 3.0 | <0.3 | <0.1 | 0.3 | | | | | 4.0 | 1.1 | 0.05 | 0.05 | yes | x |
| 9 | 17 | 3.0 | 1.0 | 2.0 | <0.1 | 0.5 | | | | | 5.8 | 0.8 | 0.04 | 0.05 | | ◎ |
| 10 | 17 | 3.0 | 1.0 | 7.0 | <0.1 | 0.5 | | | | | 6.1 | 0.7 | 0.03 | 0.04 | | ○ |
| 11 | 17 | 3.0 | 1.0 | 12.0 | <0.1 | 0.5 | | | | | 8.8 | 0.8 | 0.06 | 0.05 | yes | x |
| 12 | 17 | 3.0 | 1.0 | <0.3 | 5.0 | 0.5 | | | | | 5.6 | 0.8 | 0.03 | 0.05 | | ◎ |
| 13 | 17 | 3.0 | 1.0 | <0.3 | <0.1 | 5.0 | | | | | 5.6 | 0.9 | 0.03 | 0.05 | | ◎ |
| 14 | 17 | 3.0 | 1.0 | 5.0 | <0.1 | 0.4 | 100 | | 0.8 | 60 | 14.5 | 0.9 | 0.04 | 0.07 | yes | x |
| 15 | 17 | 3.0 | 1.0 | 5.0 | <0.1 | 0.4 | 200 | | | | 8.3 | 1.0 | 0.04 | 0.07 | | ○ |
| 16 | 17 | 3.0 | 1.0 | 5.0 | <0.1 | 0.4 | 350 | | | | 4.0 | 1.2 | 0.05 | 0.10 | | ◎ |
| 17 | 17 | 3.0 | 1.0 | 5.0 | <0.1 | 0.4 | 500 | | | | 1.1 | 1.5 | 0.10 | 0.25 | expanded | x |
| 18 | 20 | 0.2 | <0.4 | 4.2 | 1.6 | <0.1 | 400 | FIG. 2(A) | 0.05 | 60 | 3.0 | 1.8 | 0.10 | 0.02 | yes | x |
| 19 | 20 | 0.2 | <0.4 | 4.2 | 1.6 | <0.1 | | | 0.5 | | 4.0 | 1.2 | 0.06 | 0.03 | | ◎ |
| 20 | 20 | 0.2 | <0.4 | 4.2 | 1.6 | <0.1 | | | 1.5 | | 4.7 | 0.7 | 0.04 | 0.04 | | ◎ |
| 21 | 20 | 0.2 | <0.4 | 4.2 | 1.6 | <0.1 | | | 3.0 | | 5.0 | 0.4 | 0.02 | 0.03 | | x |
| 22 | 20 | 1.2 | 1.2 | 0.5 | 0.1 | 0.5 | 300 | FIG. 2(A) | 0.8 | 25 | 2.3 | 0.7 | 0.10 | 0.02 | yes | x |
| 23 | 20 | 1.2 | 1.2 | 0.5 | 0.1 | 0.5 | | | | 40 | 2.9 | 0.7 | 0.06 | 0.03 | | ○ |

TABLE 1-continued

| Sample No. | Alloy Composition of Rotor (wt %) Si | Cu | Mg | Fe | Ni | Mn | Temperature (°C.) | Results of Pressing and Forming Experiments: Shape of Die Protrusion: Shape | Point R (mm) | Tangent angle θ° | Die Load (Ton) | Groove Depth after Forming (mm) | Maximum Deformation in Length Direction (mm) | Maximum Deformation of Vane Groove (mm) | Occurrence of Cleavage and Cracking | Judgement |
|---|---|---|---|---|---|---|---|---|---|---|---|---|---|---|---|---|
| 24 | 20 | 1.2 | 1.2 | 0.5 | 0.1 | 0.5 | | | | 70 | 3.4 | 0.6 | 0.04 | 0.04 | | ◎ |
| 25 | 20 | 1.2 | 1.2 | 0.5 | 0.1 | 0.5 | | | | 80 | 3.7 | 0.6 | 0.02 | 0.03 | | x |
| 26 | 17 | 4.2 | 1.5 | 0.5 | 0.1 | 0.5 | 250 | FIG. 3(A) | | | 2.7 | 0.4 | 0.02 | 0.02 | | ◎ |
| 27 | 17 | 4.2 | 1.5 | 0.5 | 0.1 | 0.5 | | | | | 3.3 | 0.8 | 0.04 | 0.03 | | ◎ |
| 28 | 17 | 4.2 | 1.5 | 0.5 | 0.1 | 0.5 | | | | | 4.0 | 1.6 | 0.06 | 0.04 | | ○ |
| 29 | 17 | 4.2 | 1.5 | 0.5 | 0.1 | 0.5 | | | | | 5.3 | 2.4 | 0.10 | 0.07 | yes | x |

What is claimed is:

1. A method of forming an oil groove on an end surface of a rotor of a high Si Aluminum alloy having a high deformation resistance and compressing force at normal temperature, for a compressor of a vane rotary type, which comprises forming the oil groove of a concave type in a depth of at most 2.0 mm on the end surface of the rotor slidably moving in contact with a side plate, by warm-pressing a die stamp on the end surface at a rotor temperature of 200° to 450° C. by use of a metal die having a protrusion whose point has a curvature radius of 0.1 to 2.0 mm and whose side surface has a tangent angle of 30 to 75° in the pressing direction, wherein the aluminum alloy is a powder-sintered alloy or continuously case alloy consisting of:

Si: 12 to 30% by weight
Cu: 0.5 to 5% by weight
Mg: 0.2 to 2% by weight transition element: 1 to 10% by weight
Al: balance.

* * * * *